US006598995B2

(12) United States Patent
Huang

(10) Patent No.: US 6,598,995 B2
(45) Date of Patent: Jul. 29, 2003

(54) PROPPED UP LAMP STRING WOUND WITH ROLLED UP TAPES

(76) Inventor: Shun-Feng Huang, P.O. Box 697, Feng-Yuan City 420 (TW)

( * ) Notice: Subject to any disclaimer, the term of this patent is extended or adjusted under 35 U.S.C. 154(b) by 0 days.

(21) Appl. No.: 09/985,991

(22) Filed: Nov. 7, 2001

(65) Prior Publication Data

US 2003/0086263 A1 May 8, 2003

(51) Int. Cl.[7] ..... F21V 21/00

(52) U.S. Cl. ..... 362/249; 362/391; 362/396; 362/806

(58) Field of Search ..... 362/123, 806, 362/431, 249, 391, 252, 396

(56) References Cited

U.S. PATENT DOCUMENTS 5,158,355 A * 10/1992 Sarate ..... 362/122
5,913,600 A * 6/1999 Lin ..... 362/391
6,135,623 A * 10/2000 Lin ..... 362/431

* cited by examiner

*Primary Examiner*—Sandra O'Shea
*Assistant Examiner*—Guiyoung Lee

(57) ABSTRACT

A propped up lamp string wound with rolled up tapes includes a flexible prop, a string of Christmas lights having a plurality of the electric wires parallel depended on the prop and a plurality of sockets with lamp thereon respectively inserted into a plurality of clamp members which has an upper part and a lower part obliquely clipped on the prop at predetermined intervals and rolled up a tape in a pencil like shape wound on the prop and the electric wire of the string of Christmas light and heated to integrate with the electric wires and the prop. Thereby the propped up lamp string can be bent into different shapes of patterns or gathered into a pot of a post to make a garden lamp.

4 Claims, 5 Drawing Sheets

PROPPED UP LAMP STRING WOUND WITH ROLLED UP TAPES

This application in part discloses and claims subject matter disclosed in my earlier filed pending application, Ser. No. 09/982,394 Filed Oct. 18, 2001.

BACKGROUND OF THE INVENTION

The present invention relates to Christmas lights or garden lamp and more particularly to a propped up lamp string wound with rolled up tapes.

A string of Christmas lights is used to wind on a Christmas tree or to hang a shaped up object to provide cosmetic effect. It would not make a shape itself because there is no any prop to support it. Ideally, if there is a prop made of flexible material such as the metal wire to prop it, the string of Christmas lights can be made into different shapes. However, the prop could not integrate with the lamp string if there is nothing to bind it.

SUMMARY OF THE PRESENT INVENTION

The present invention has a main object to provide a propped up lamp string wound with rolled up tapes in which a plurality of clamp member are obliquely clipped on the prop, at regular intervals for engaging with the sockets of the lamp string and the electric wires of the string are parallel wound with the prop by a rolled up tape. So that they are integrated with each other and looks beatified.

Accordingly, the propped up lamp string wound with rolled up tapes of the present invention comprises generally a string of Christmas light, a flexible prop, a plurality of clamp members obliquely clipped on the prop at regular intervals for engaging the sockets of the string of Christmas lights on one by one basis. The electric wires of the string are parallel depended on the prop and wound by the rolled up tapes which is previously shaped into a pencil like roller so as to be convenient to wind on the prop. After the winding of the tape on the prop and the electric wires, they are heated to get integrated with each other, due to the flexibility of the prop, the propped up lamp string can be able to make different shapes of patterns.

The present invention will become more fully understood by reference to the following detailed description thereof when read in conjunction with the attached drawings.

DETAILED DESCRIPTION OF THE PREFERRED EMBODIMENT

Figure 1:
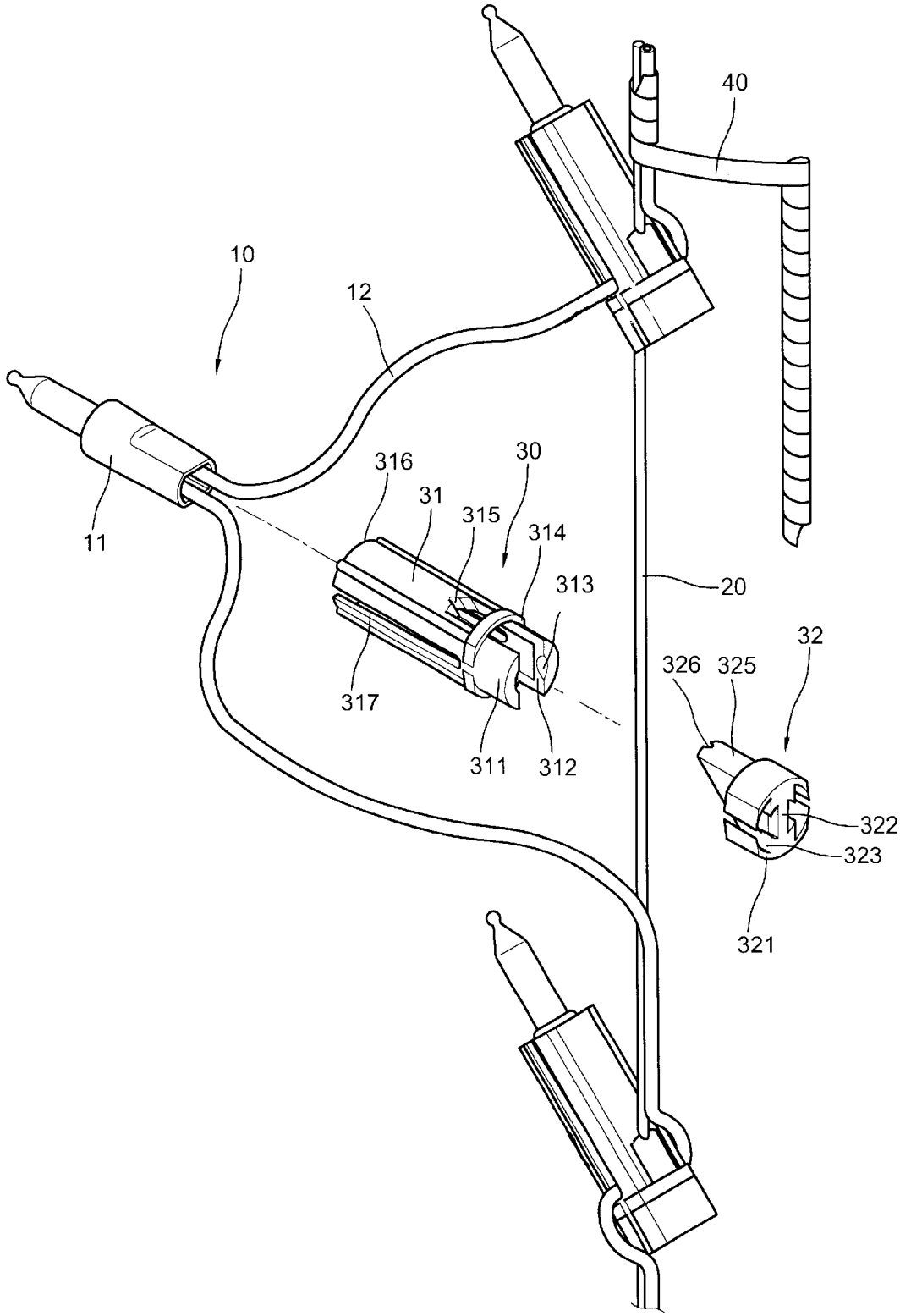
FIG. 1 is a perspective to show the preferred embodiment of the present invention while the tape begins to wind the prop and the electric wires.
Figure 2:
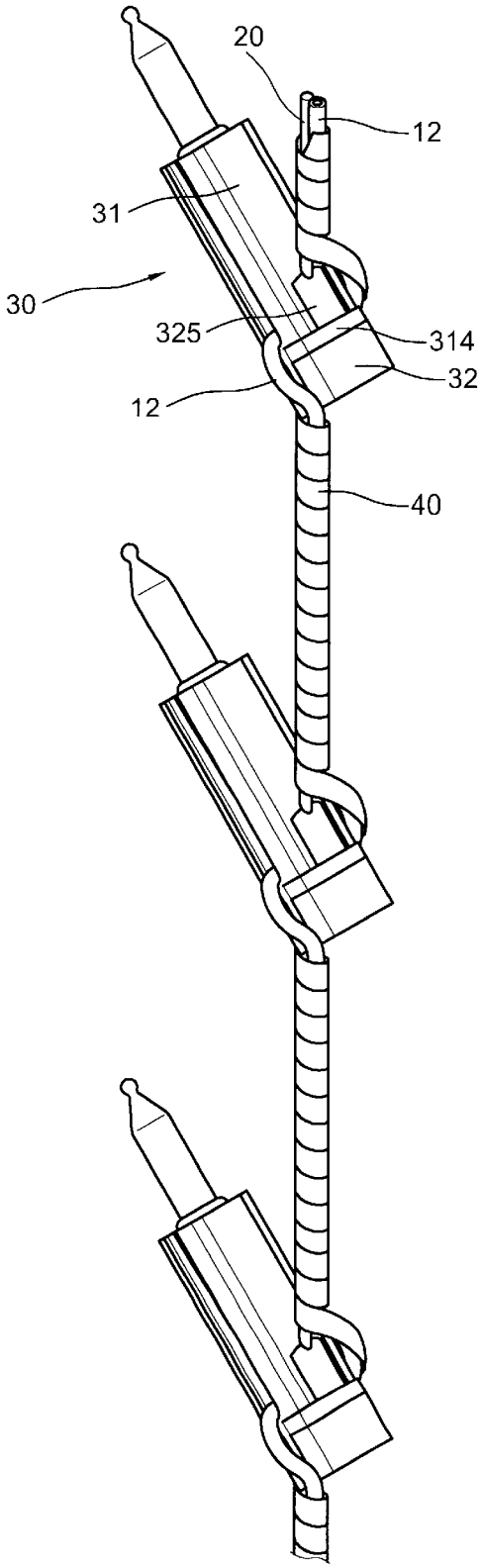
FIG. 2 is a perspective view of FIG. 1 while the tape is already bound on the prop and the electric wires.
Figure 3:
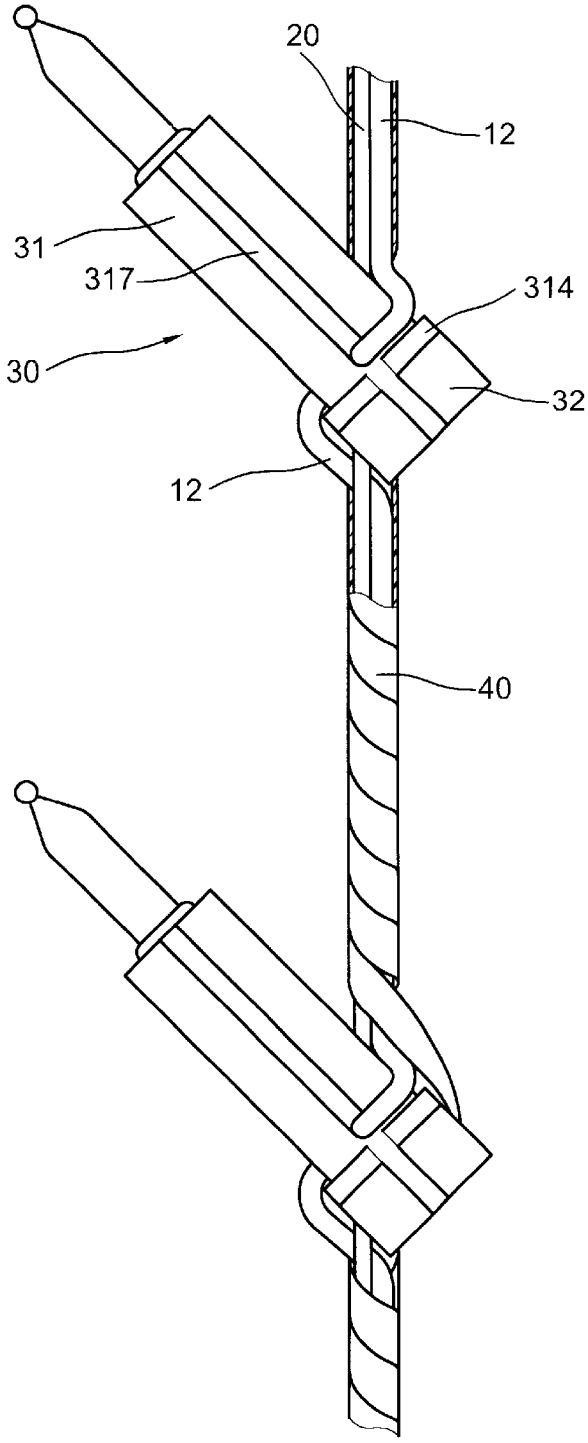
FIG. 3 is a perspective view to show the electric wires depending on the prop.

With reference to FIGS. 1, 2 and 3 of the drawings, the propped up lamp string wound with rolled up tapes of the present invention comprises generally a string of Christmas lights 10, a flexible prop 20 plurality of clamp members 30 obliquely and spacedly clipped on the prop 20 at predetermined intervals and a rolled up tape 40.

The string of Christmas lights 10 has a plurality of socket 11 with lamp thereon and regularly connected in series by electric wires.

Figure 5:
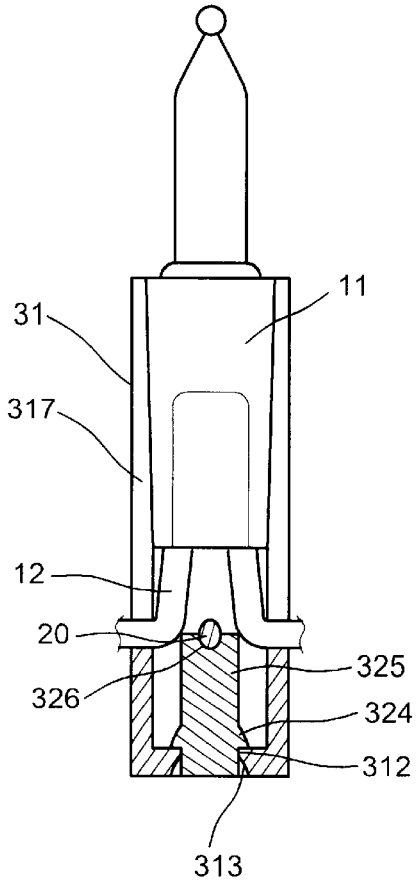
FIG. 5 is a cross section of the clamp member.
Figure 4:
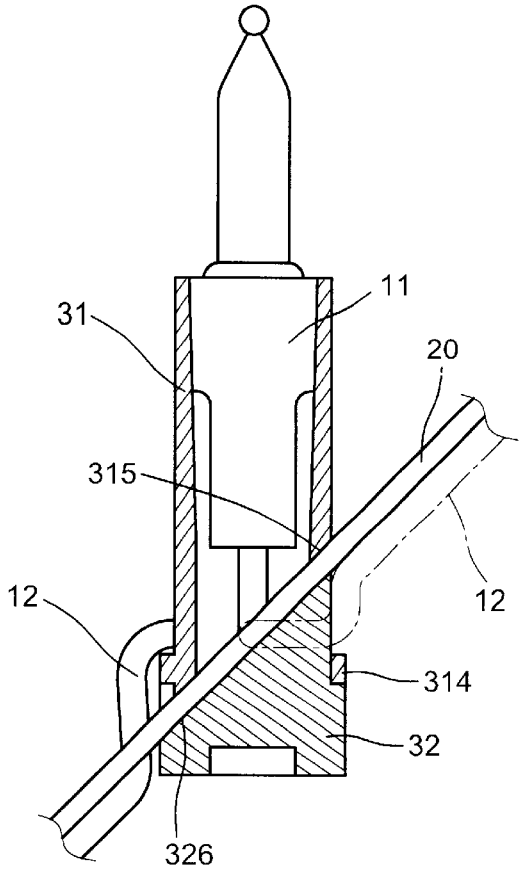
FIG. 4 is a longitudinal section to show the clamp member on the prop.

The clamp member 30 includes an upper part 31 and a lower part 32. The lower part 32 has a pair of symmetrically formed gaped arcuate plates 321 separated by a I-shaped partition 322 to define a pair of crescent spaces 323 therebetween, a pair of triangular stop plates 324 symmetrically formed on lateral side of the partition 322 (as shown in FIG. 5), a bevel plate 325 extended upward from the partition 322 and a second slot 326 centrally formed in the sloped portion of the bevel plate 325 engageable with the prop 20. Due to that the arcuate plates are made of plastic material and each has a gap at middle portion, they will provide greater elasticity. The upper part 31 has a tubular body, a pair of inlaid pieces 311 of crescent section symmetrically extended outward from the bottom of the body engageable into the crescent spaces 323 of the lower part 32 and each having a hooked end on the inner surface checked by the triangular stop plates 324 and an arcuate depression 313 in the distal portion, a hoop 314 around the outer periphery above the inlaid pieces 311, a first slot 315 slopedly extended across the center of the body engageable with the prop 20 and the second slot 326 of the lower part 32 (as shown in FIG. 4), an opening 316 in the top of the body for receiving the socket 11 into the body and pair of slender slits 317 symmetrically formed in the opposing peripheries of the body for permitting the electric wires 12 passing through and depending on the prop 20.

The prop is made of flexible material which may be the pliable metal or plastic.

The rolled up tape 40 is made of plastic material and has been previously shaped into pencil like roller.

When assembly, first obliquely clip the clamp members 30 on the prop 20 at predetermined intervals in the manner as described the above because of that the gaped arcuate plate is elastic, the inlaid pieces 311 of the upper part 31 are easily inserted into the crescent spaces 323 and the hooked ends 312 are easily engaged with the triangular stop plates 324 therefore the clipping of the upper part 31 with the lower part 32 is very tight, then insert the sockets 11 of the string of Christmas lights into the opening 316 of the clamp members 30 on one by one basis, the electric wires 12 will automatically pass through the slender slits 317 and depend on the prop 20 because of that the length of the wires are equal to the intervals of the clamp members 30 and then wind the rolled up tape 40 onto the prop 20 and electric wires 12, due to the pencil like shape of the tape 40, the winding process is rather convenient without paying too much attentions, when meet a clamp member 30, the tape 40 will be jumped aver to avoid disorder. Once the winding process is completed, a heating process is performed to make the tape 40 integrated with the prop 20 and the electric wires 12. FIG. 3 shows an outlook of the finished product of the propped up lamp string wound with rolled up tapes of the present invention which can be bent over t make different shapes of patterns.

Figure 6:
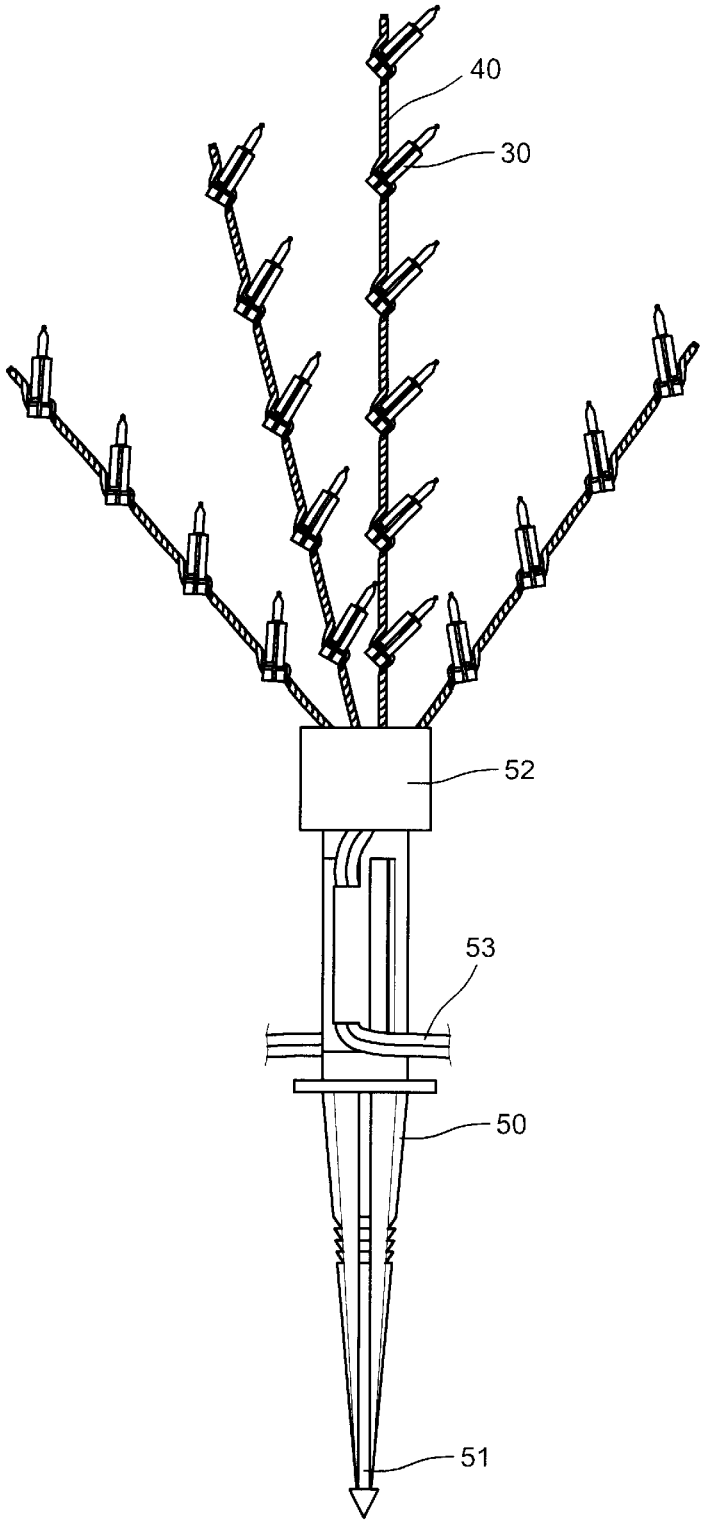
FIG. 6 is a plane view to show that the propped up string of Christmas lights can be used to a garden lamp.

Referring to FIG. 6, this finished product can be inserted into post 50 to make a garden lamp. The post 50 has a tip portion 51 on lower end for placing the garden lamp in a ground such as the soil or lawn and pot 52 on the top to receive a plurality of the propped lamp strings of the present invention. The electric wires 12 of the propped up lamp strings are gathered to connected with a pair of electric wires 53 in the post 50. The electric wires 53 are capable of connecting with other garden lamps or the power source. Since the prop 20 is flexible, these propped up lamp strings can be bent over to make different shapes of flowers to provide cosmetic effect.

The present invent ion has at least the following features:

a) The clamp member obliquely clipped on the prop at predetermined intervals to facilitate regular insertion of the sockets therein and to enable the electric wires to depend on the prop, b) The tape is previously shaped into a pencil like roller which is convenient to wind on the prop and the electric wires, and c) The finished product can be bent into different shapes and applied to a post to make a garden lamp.

The specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

I claim:

1. A propped up lamp string wound with rolled up tapes comprising:

a plurality of clamp members obliquely clipped on a prop at predetermined intervals for respectively inserting a plurality of sockets from a string of Christmas lights which has electric wires parallel depended on the prop and wound by a rolled up tape, said clamp members each having an upper part including a tubular body, an opening in top to receive the socket, a pair of slender slits symmetrically formed in opposing peripheries of the body for passing through the electric wires of the string of Christmas lights, a pair of inlaid pieces of crescent section symmetrically formed and extended outward from bottom of the body each having a hooked end on inner surface and an arcuate depressing in distal portion thereof, a hoop around an outer periphery of the body above the inlaid pieces and a first slot slopedly extending across center of the body engageable with the prop; a lower part including a pair of gaped arcuate plates symmetrically formed on lower portion and separated by an I-shaped partition so as to define a pair of crescent spaces for receiving the inlaid pieces of the upper part, a pair of triangular stop plates symmetrically formed on lateral sides of the partition to check the hooked ends of the upper part, a bevel plate extend upward from the partition and a second slot centrally formed in sloped portion of the bevel plate engageable with the prop and the first slot of the upper part.

2. The propped up lamp string as recited in claim 1 wherein said prop is made of flexible material such as pliable metal and/or plastic.

3. The propped up lamp string as recited in claim 1 wherein said rolled up tape is shaped into a pencil like roller and heated to integrate with said prop and said electric wires.

4. The propped up lamp string as recited in claim 1 wherein said propped up lamp string may be bent to make different shapes of patterns.

* * * * *